US005433441A

United States Patent [19]

Olsen et al.

[11] Patent Number: 5,433,441

[45] Date of Patent: Jul. 18, 1995

[54] GOLF PUTTER WITH CYLINDRICAL CLUBHEAD

[76] Inventors: Christopher K. Olsen, 104 Honeysuckle La., Cary, N.C. 27513; Charles Tomasino, 4316 Oak Park Rd., Raleigh, N.C. 27612

[21] Appl. No.: 155,997

[22] Filed: Nov. 22, 1993

[51] Int. Cl.[6] ..... A63B 53/02; A63B 53/04

[52] U.S. Cl. ..... 273/80 C; 273/167 C; 273/175; 273/169; 273/167 A; 273/167 G

[58] Field of Search ..... 273/167 R, 167 C, 169, 273/167 F, 164.1, 80.1, 80.2, 80 C, 167 G, 167 J, 168, 167 A, 193 R, 194 R, 194 A, 67 R, 56, 83

[56] References Cited

U.S. PATENT DOCUMENTS

| | | | |
|---|---|---|---|
| 1,257,471 | 2/1918 | Fitzjohn | 273/169 |
| 2,478,468 | 8/1949 | Drake | 273/80 C |
| 2,820,638 | 1/1958 | Morrison | 273/80 C |
| 3,194,564 | 7/1965 | Swan | 273/80 C |
| 3,399,898 | 9/1968 | Burkland . | |
| 3,430,963 | 3/1969 | Wozniak et al. . | |
| 3,472,512 | 10/1969 | Berry | 273/83 |
| 3,519,271 | 7/1970 | Smith | 273/80.2 |
| 3,909,005 | 9/1975 | Piszel . | |
| 3,989,257 | 11/1976 | Barr | 273/164.1 |
| 4,222,566 | 9/1980 | Berry . | |
| 4,508,342 | 4/1985 | Drake . | |
| 4,508,350 | 4/1985 | Duclos | 273/169 X |
| 4,688,799 | 8/1987 | Johnson | 273/164.1 |
| 4,776,594 | 10/1988 | Rango . | |
| 4,861,038 | 8/1989 | Fucinato . | |
| 4,872,684 | 10/1989 | Dippel . | |
| 4,881,737 | 11/1989 | Mullins . | |
| 5,090,698 | 2/1992 | Kleinfelter . | |
| 5,193,806 | 3/1993 | Burkley . | |

FOREIGN PATENT DOCUMENTS

| | | | |
|---|---|---|---|
| 14169 | of 1848 | United Kingdom | 273/167 R |
| 323897 | 1/1930 | United Kingdom | 273/167 R |

*Primary Examiner*—Sebastiano Passaniti
*Attorney, Agent, or Firm*—Richard E. Jenkins

[57] ABSTRACT

An improved golf putter featuring a two piece cylindrical clubhead comprising a rod constructed from a hard material and fastened inside a thin walled tube cast from soft, malleable material such as copper. The club and clubhead are designed so as to improve balance, efficiency, and feel, and to impart initial forward rotational spin to the golf ball. The shaft is connected to the clubhead in such a manner as to align the shaft with the center of the clubhead, thereby maximizing the size of the "sweet spot," and to create a lie angle of between 65 and 76 degrees.

6 Claims, 6 Drawing Sheets

GOLF PUTTER WITH CYLINDRICAL CLUBHEAD

BACKGROUND OF THE INVENTION

1. Field of the Invention

The present invention relates to instruments used in the game of golf to strike and propel the golf ball, and more particularly a golf putter to strike and propel the golf ball to roll over a relatively smooth surface into a hole.

2. Description of the Prior Art

Since the game of golf began, many years ago, various different forms of golf putters have been used to propel the golf ball over the putting surface into the hole with the least number of times necessary to strike the ball. A number of these putters feature partially or generally cylindrical clubheads. These include U.S. Pat. No. 3,399,898, Sep. 3, 1968, C. A. Burkland; 3,430,963, Mar. 4, 1969, J. J. Wozniak, et. al; 3,909,005, Sep. 30, 1975, G. A. Piszel; 4,222,566, Sep. 16, 1980, T. R. Berry; 4,508,342, Apr. 2, 1985, R. C. Drake; 4,776,594, Oct. 11, 1988, J. F. Rango; 4,861,038, Aug. 29, 1989, G. J. Fucinato; 4,872,684, Oct. 10, 1989, S. A. Dippel; 4,881,737, Nov. 21, 1989, B. J. Mullins; 5,090,698, Feb. 25, 1992, T. A. Kleinfelter; and 5,193,806, Mar. 16, 1993, A. J. Burkley. (It should be noted that several of the putters described within these patents do not meet current United States Golf Association specifications.) These cylindrical clubheads impart forward rotational spin to the golf ball when they strike it; however, none are designed to maximize the potential balance, efficiency, and feel capabilities of the cylindrical clubhead design. In addition, no patents could be found which claim the new use of plumbing water pipes as materials for the construction of golf putter clubheads.

There are many different situations which must be overcome to get the golf ball into the hole. These include such factors as distance, undulations of the surface the ball must traverse, the direction the grass grows on that surface, and wind factors among others. Every advantage possible is needed to get the ball to go into the hole with the least number of times it has to be struck. However, with this instrument it will be easier to overcome these situations, and gain more of an advantage. Furthermore, the instrument described herein does comply with current United States Golf Association specifications and requirements.

SUMMARY OF THE INVENTION

1. Overwiew

For better players, putting is the most important part of the game of golf. While a long drive which lands in the fairway or a well struck 5-iron drive which stops on the putting surface are both important and satisfying, good putting is necessary to convert overall solid play into low scores. Conversely, good putting can often salvage acceptable scores despite poor tee and/or approach shots, but, for better players, poor putting will almost certainly lead to unacceptably high scores.

Traditional putter designs featuring a flat ball striking surface have two primary disadvantages: 1) A lofted flat ball striking surface causes the ball to skid rather than roll forward immediately after impact, and 2) The loft of a flat ball striking surface will not remain constant. With respect to the second disadvantage, the loft will increase as the ball is placed further forward in the player's stance, and the loft will decrease as the ball is placed further back in the stance. The first disadvantage could conceivably be overcome by designing a putter with a flat ball striking surface which has no loft (wherein the flat ball striking surface is exactly perpendicular to the putting surface), but the second primary disadvantage can only be overcome by changing the shape of the ball striking surface itself. As shown in FIGS. 3 and 4, the cylindrical shaped head of the present golf putter invention encourages initial forward rotational spin when the ball is struck by the lower half of the cylinder. In addition, as shown in FIG. 4, the curved ball striking surface of the cylindrical clubhead also corrects the second primary disadvantage of traditional putters by providing a consistently shaped ball striking surface regardless of the placement of the golf ball within a player's stance.

2. Improved Balance

As mentioned in the description of the prior art, other golf putter inventions featuring generally or partially cylindrical clubheads are known to exist; however, none is designed to maximize the potential balance, efficiency, and feel capabilities of the cylindrical clubhead design. Balance is the most important aspect of any golf putter design. The size of the "sweet spot" of a properly balanced putter will be maximized and will be located in the center of the putter's ball striking surface. Proper balance is achieved by aligning the shaft of the putter with the center of the clubhead, a process referred to as "face balancing." This does not mean that the shaft must enter or pass through the center of the clubhead. FIGS. 5 and 6 show several possible means by which the shaft can be attached to the clubhead of the present invention whereby the putter will be face balanced.

3. Improved Efficiency

A golf putter's efficiency is the amount of energy imparted by the player's swing which is transferred to the golf ball when it is struck by the clubhead. Unlike most machines, the efficiency of a golf putter cannot be easily measured or quantified. However, it is logical to conclude that the most important factor in designing a golf putter with improved efficiency is to ensure proper face balancing. Yet another way to improve a golf putter's efficiency is to attach the shaft to the clubhead directly behind the center of the ball striking surface, as depicted in FIG. 6. With this design, increased energy is imparted from the shaft of the putter to the clubhead, thereby increasing the amount of energy transferred to the golf ball upon impact. In addition, the increased efficiency of the shaft design depicted in FIG. 6 helps the player keep the golf ball on its intended line in the event that the ball is not struck in the center of the sweet spot; the clubhead is less likely to torque or twist during off-center hits. A second embodiment of the present invention, which is depicted in FIG. 7, features mushroom shaped endcap "skids" which enhance the putter's efficiency in two ways: 1) The skids decrease the surface area of the clubhead which can unintentionally drag against the ground, thereby decreasing the energy lost when the clubhead strikes the ground during a poor swing, and 2) The diameter of the skids can be as large as 1.68" (the size of a regulation golf ball) in order to raise or lower the sweet spot of the clubhead, thereby customizing the putter to the individual player's swing.

4. Improved Feel

The present invention utilizes a two piece cylindrical clubhead design in order to provide better "feel" than previously known putters. As shown in FIG. 2, the clubhead comprises a solid (or hollow) cylindrical bar inside a thin tube. The outside tube is manufactured from a relatively soft and malleable metal such as copper, silver, gold or any other stable and relatively soft and malleable material. Fastened inside the thin tube is a cylindrical bar manufactured from any hard material which will provide an adequate overall length to weight ratio. Such materials may include, but are not limited to, aluminum, steel, iron, glass, granite, or any combination thereof. Upon initial impact with a golf ball, the soft, malleable outside tube will compress inward into the hard inner rod. After compressing into the inner rod, the outer tube will then expand, causing the ball to jump off of the clubhead and roll accurately along the path upon which the putter's clubhead was swung. The outer tube compression into the hard inner rod, followed by the subsequent expansion causing the ball to jump off of the face of the clubhead, provides the player with a satisfying "click" upon impact between the clubhead and golf ball. In essence, the player can actually determine the quality of his or her stroke by the feel of the aforementioned impact. U.S. Pat. No. 5,090,698, issued to Thomas A. Kleinfelter on Feb. 25, 1992, features a somewhat similar two piece clubhead design; however, the outer tube of the clubhead described therein does not remain in contact with the inside element throughout the entire length of the clubhead. Instead, contact is made between the outside tube and the inside element only at the ends of the inside element, thereby creating a space between the outside tube and inside element throughout the portion of the clubhead which is intended to impact the golf ball. As such, the outside tube of the clubhead will not compress into the inside element, and will therefore not create the improved feel of the present invention described herein.

5. Further Objects and Advantages

Further objects and advantages of the present invention will become apparent from a consideration of the drawings and ensuing description.

Reference Numerals in Drawings

Figure 1A:
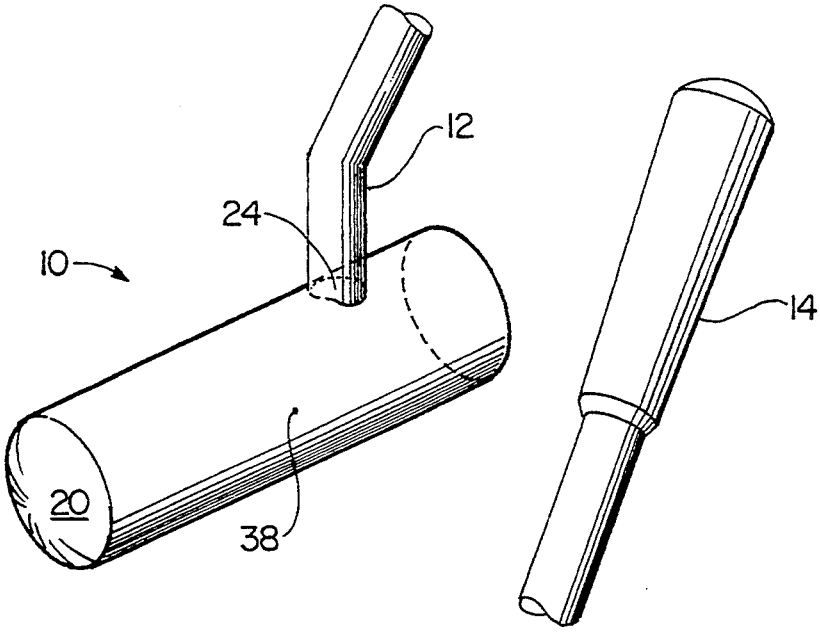
FIG. 1 shows general drawings of the clubhead, along with perspective front and side views in FIGS. 1A, 1B and 1C respectively. The shaft is broken and the grip is shortened in order to conserve space. The clubhead is drawn to scale.

10 clubhead
12 shaft (single bend embodiment)
12A shaft (straight embodiment)
12B shaft (double bend embodiment)
14 grip
16 thin cylindrical tube
18 solid or hollow rod
20 mushroom shaped endcap
22 stem of endcap
24 hole drilled into clubhead for insertion of shaft
24A alternative hold drilled into clubhead for insertion of shaft
26 horizontal axis line through center of clubhead
28 vertical diameter line through center of clubhead
29 horizontal diameter line through center of clubhead
30 center of clubhead (intersection of 26 and 28)
31 radius of clubhead
32 lie angle
34 alignment line of center axis
36 endcaps measuring up to 1.68" in diameter
38 sweet spot portion of ball striking face of club
40 putting green surface
42 golf ball
44 center of golf ball
46 swing path

DESCRIPTION OF THE PREFERRED EMBODIMENT

Figure 1B:
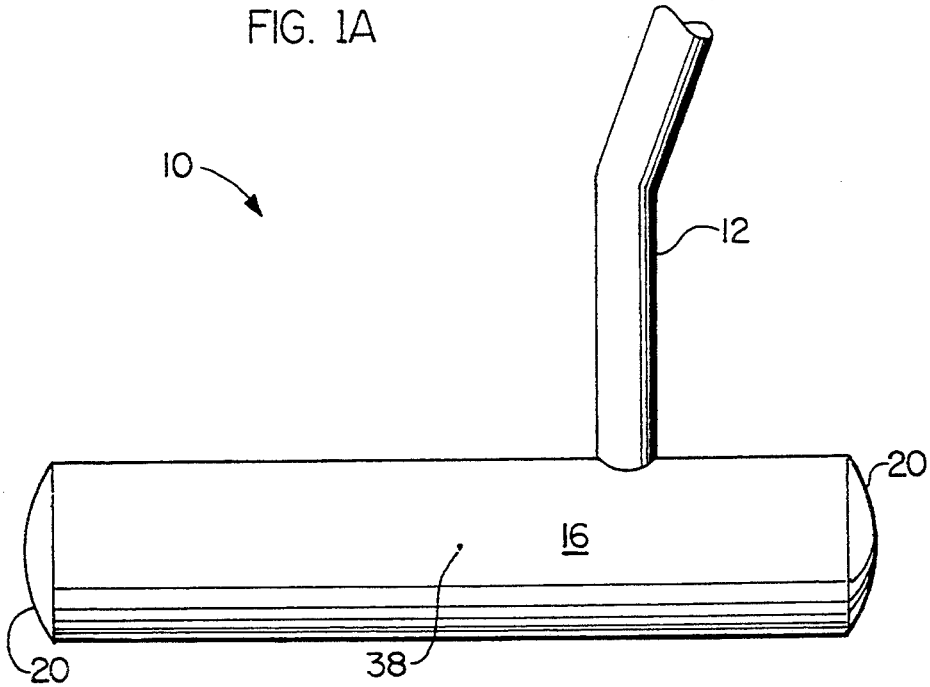
Figure 1C:
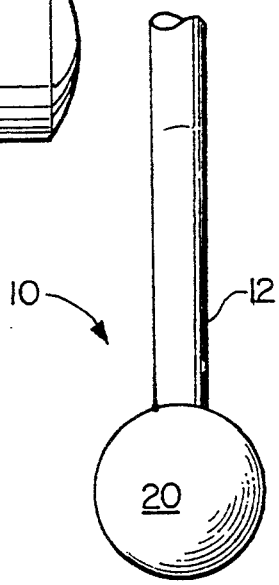
Figures 2A, 2B:
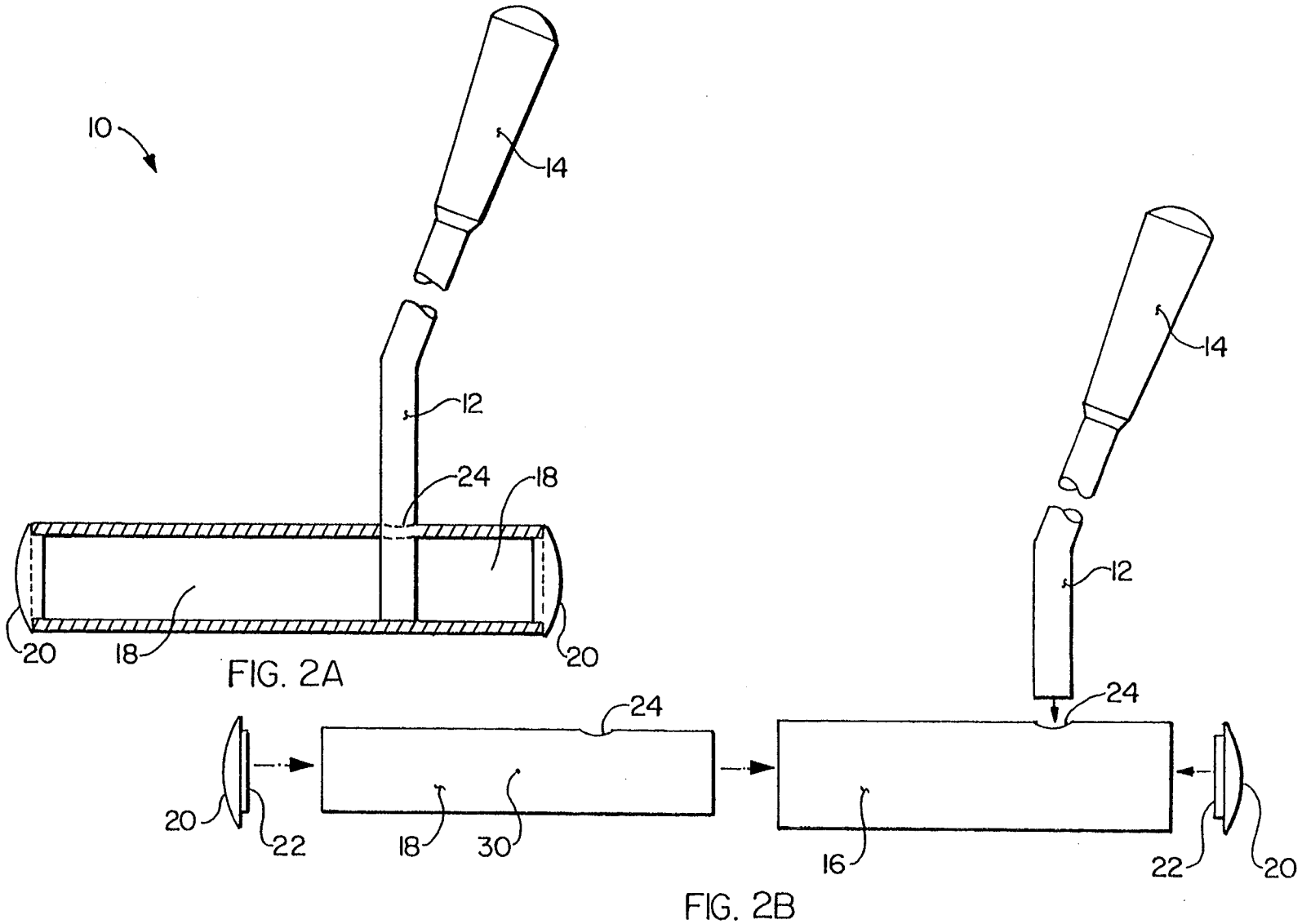
FIG. 2 shows assembly and exploded views both of which are side views, in FIGS. 2A and 2B, respectively, illustrating the relationship between the various components of the invention. The shaft is broken and the grip is shortened in order to conserve space.
Figure 3:
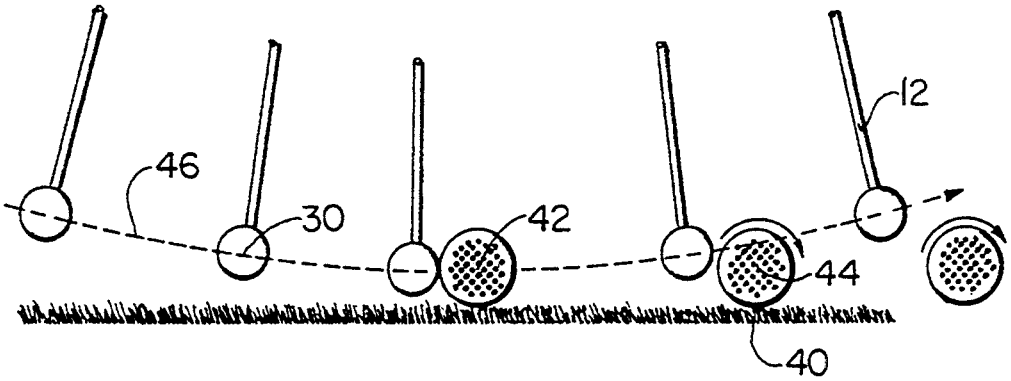
FIG. 3 shows the use of invention with its swing arc.
Figure 4:
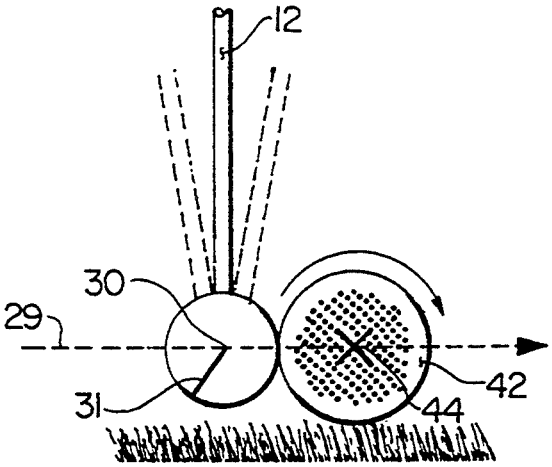
FIG. 4 shows an enlarged view of the use of the invention, and shows that the distance from the impact point of the striking surface of the cylindrical clubhead with the ball to the horizontal axis line of the cylindrical clubhead will not vary when the ball is placed further forward or back in the player's stance since this distance is the radius of the clubhead, as the clubhead is a cylinder.
Figure 5A:
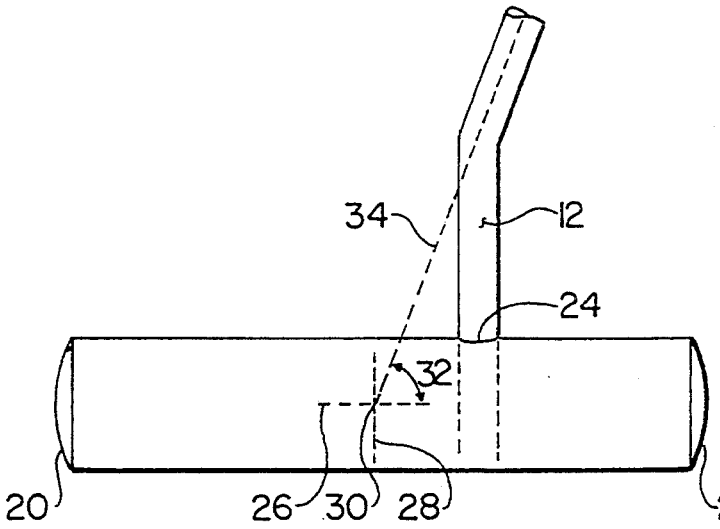
FIG. 5 shows front and side views in FIGS. 5A and 5B, respectively, of an embodiment with a bent shaft, and front and said views in FIGS. 5C and 5D, respectively, of an embodiment with a straight shaft, both of which embodiments illustrate means for aligning and affixing the shaft to the clubhead of the invention.
Figure 5B:
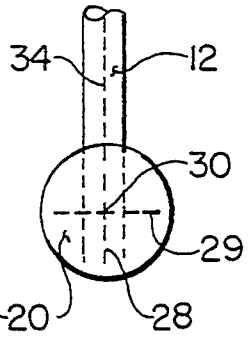
Figure 5C:
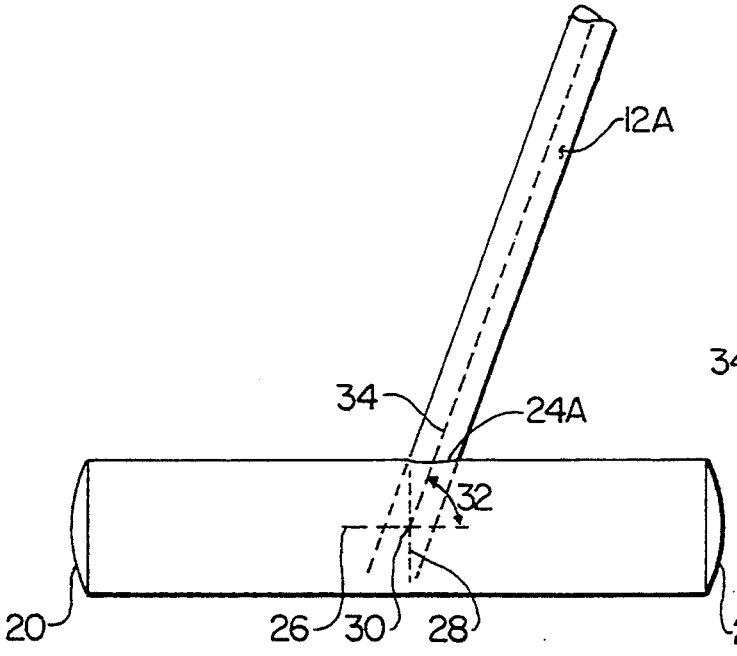
Figure 5D:
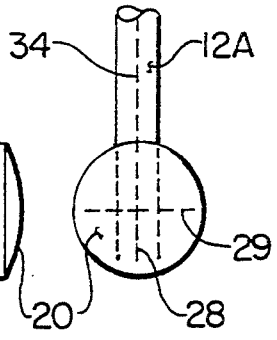

Shown in FIG. 1 is a cylindrical clubhead 10 embodying the present invention. The clubhead is attached to the bottom of a shaft 12 of standard manufacture (either 34" to 36", or the longer 48" to 54" long shaft popularized by the Senior PGA Tour), and as shown in FIGS. 1 and 2, placed over the top end of the shaft is a putter grip 14 of standard manufacture.

The clubhead 10 weighs between 250 and 500 grams, and comprises a thin cylindrical tube 16, inside of which is a solid or hollow cylindrical rod 18. The tube 16 has an outside diameter of approximately 1.11", an inside diameter of approximately 1.05", a wall thickness of approximately 0.06", and is 3" to 6" in length. The tube 16 is cast from a relatively soft and malleable metal such as copper, gold, silver or any similar metal, or any other material which possesses characteristics similar to copper, silver or gold. One such possible material for the tube 16 is 1.1" Type M copper water plumbing pipe of standard manufacture. Fastened and centered inside the tube 16 is the rod 18, which is approximately 1.04" in diameter and is between 0.12" and 0.38" shorter than the tube 16. The rod 18 is affixed inside the tube 16 via any suitable metal adhesive, and is manufactured from any hard material which will provide an adequate overall length to weight ratio. Such materials may include, but are not limited to, aluminum, steel, iron, glass, granite, or any combination thereof. A ¾" inside diameter galvanized steel water plumbing pipe of standard manufacture and cut to the desired length noted above is an excellent material for fabrication of the rod 18.

Figure 7B:
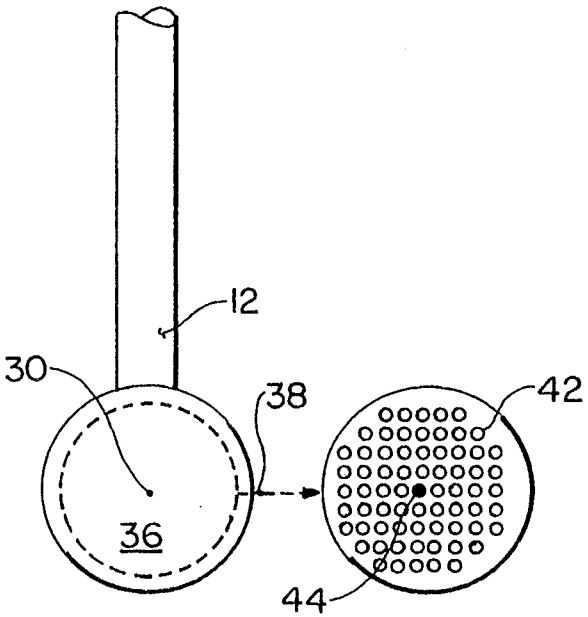
FIG. 7 shows front and side views in FIGS. 7A and 7B, respectively, of a second embodiment featuring larger endcaps.
Figure 7:
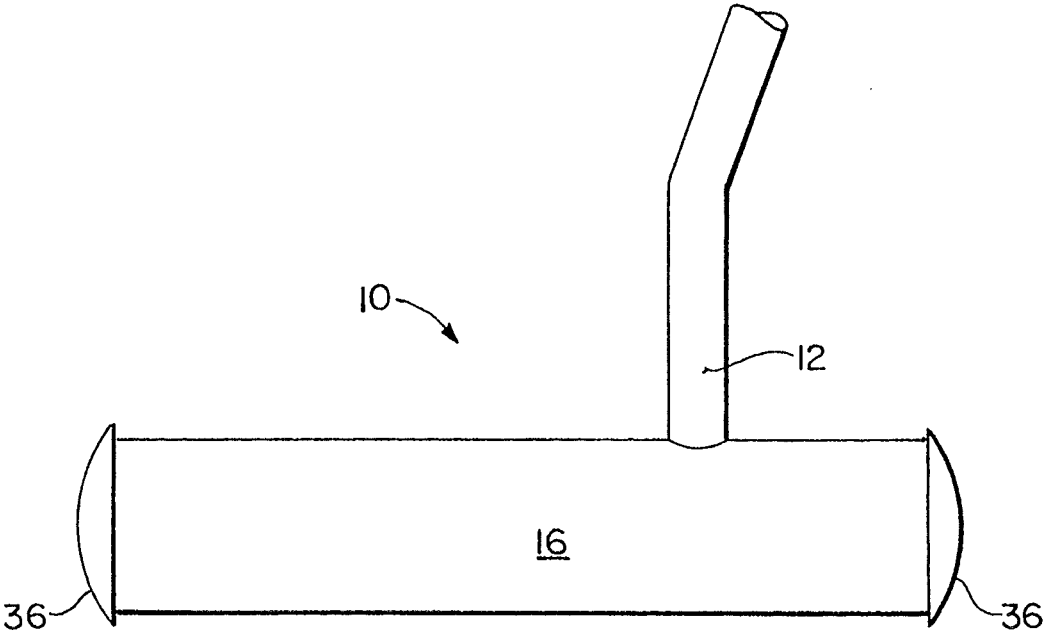

As noted above, the rod 18 is approximately 0.12" to 0.38" shorter-than the tube 16. This relationship is designed such that once the rod 18 is affixed and centered inside the tube 16, there will be a space of approximately 0.06" to 0.19" remaining between the end of the rod 18 and the tube 16 on either side of the clubhead. On either side of the clubhead 10 is attached a mushroom shaped endcap 20. The endcap 20 is generally circular in shape, having a diameter which is at least as large as the tube 16, but no larger than the diameter of a standard golf ball (1.68"). The preferred diameter of the endcap 20 is approximately 1.11", the same as the outside diameter of the tube 16; however, a second embodiment of the invention is depicted in FIG. 7 and features larger endcaps 36 which are referred to as "skids" and are designed for the purposes set forth in the Improved Efficiency section above. The endcap 20 is constructed such that it has a stem 22 which has a depth of approximately 0.05" to 0.18" and a diameter of approximately 1.04", which is the same approximate diameter as the rod 18. The size of the stem 22 of the endcap 20 is designed such that the stem can be affixed inside the tube 16 against each end of the rod 18 using any suitable adhesive, or by any other acceptable means. Ideally, the endcap is made from wood or the same material as the tube 16, but may be machined or turned from any material which will be aesthetically acceptable. In addition, the endcap need not be mushroom in shape, and may be flat such that it fits entirely inside and flush with the ends of the tube 16.

Figure 6A:
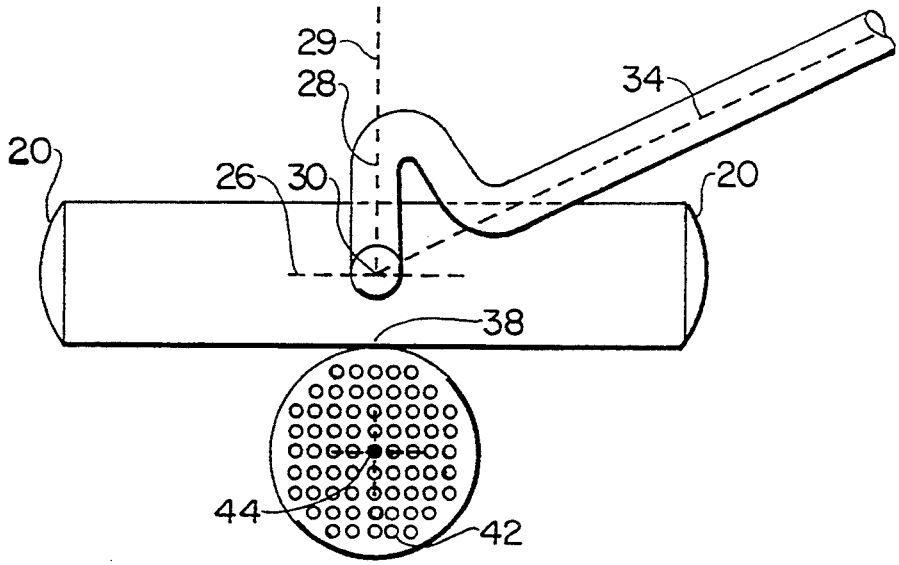
FIG. 6 shows top, front and side views in FIGS. 6A, 6B and 6C, respectively, of means for aligning and affixing the shaft whereby the shaft is of a double bend embodiment for golfing in a right-handed manner and enters the clubhead directly behind the clubhead's ball striking surface.
Figure 6B:
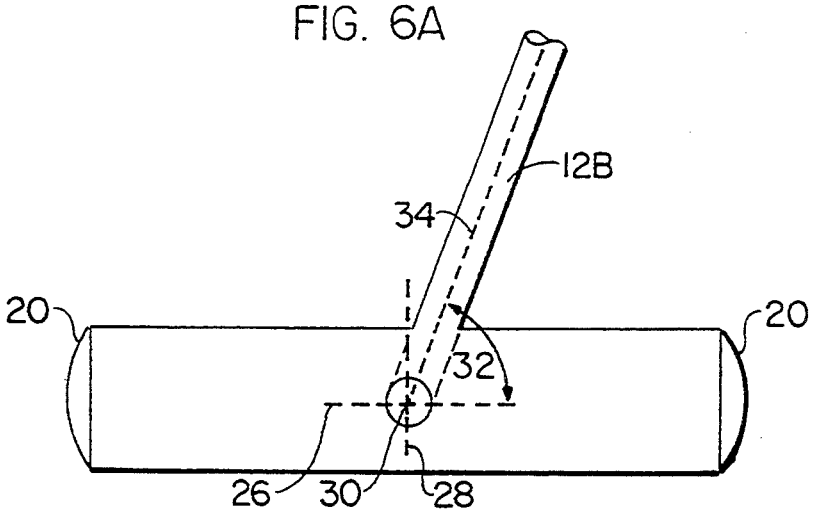
Figure 6C:
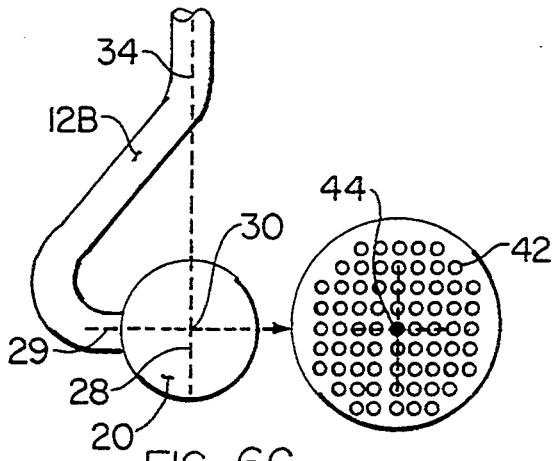

Using any suitable metal to metal adhesive, the shaft 12 is attached to the bottom of the clubhead 10 through a hole 24 drilled into the club for insertion of the shaft. The hole 24 is drilled to such a size as to accommodate a standard shaft tip (usually either 0.370" or 0.355"). In order to properly balance the putter, the shaft 12 is bent and attached to the clubhead 10 such that the :shaft is aligned at an angle tangent to a point created where an imaginary horizontal line 26 and vertical line 28 pass through the center 30 of the clubhead 10 as depicted in FIGS. 5 and 6. While such alignment is preferred, it should not be construed as the only means for aligning the shaft 12 of the invention. The lower portion of the shaft is bent so as to create a lie angle 32 of between 65 and 76 degrees.

The foregoing is considered as illustrative only of the principles of the invention. Further, since numerous modifications and changes will readily occur to those skilled in the art, it is not intended to limit the invention to the exact construction and operation shown and described; accordingly, the invention is not to be limited to the specific forms, sizes, or arrangement of parts described and shown.

We claim:

1. A putter instrument which can be used to strike a golf ball propelling it over a relatively smooth putting surface into a hole, the putter instrument comprising in combination:

(I) a cylindrically shaped clubhead, the clubhead having a center and also having a horizontal center axis with a midpoint and a vertical diameter with a midpoint, and the midpoint of the horizontal center axis and the midpoint of the vertical diameter forming an intersection defining the center of the clubhead, the clubhead comprising:

a) a thin cylindrically shaped tube constructed from a relatively soft and malleable material, and having an outside and an inside with the outside defining the ball striking surface of the clubhead, and b) a cylindrically shaped rod constructed from a relatively hard material which will provide an acceptable length to weight ratio, the rod being fastened throughout the entire length thereof to the inside of the tube;

(II) a shaft, the shaft being attached to the clubhead and having an alignment center axis for aligning the shaft with the center of the clubhead, such that the alignment center axis of the shaft intersects with the center of the clubhead and forms a lie angle of 65° to 76° with the horizontal center axis of the clubhead; and (III) endcaps attached to the clubhead for adjusting the height between the putting surface and the center of the clubhead.

2. The instrument set forth in claim 1 wherein the material of the rod comprises a plumbing water pipe.

3. The instrument set forth in claim 1 wherein the material of the tube is selected from the group consisting of copper, silver, gold, and combinations thereof.

4. A putter instrument which can be used to strike a golf ball propelling it over a relatively smooth putting surface into a hole, the putter instrument comprising in combination:

(I) a cylindrically shaped clubhead, the clubhead having a center and also having a horizontal center axis with a midpoint and a vertical diameter with a midpoint, and the midpoint of the horizontal center axis and the midpoint of the vertical diameter forming an intersection defining the center of the clubhead, the clubhead comprising:

a) a thin cylindrically shaped tube constructed from a relatively soft and malleable material, and having an outside and an inside with the outside defining the ball striking surface of the clubhead, and b) a cylindrically shaped rod constructed from a relatively hard material which will provide an acceptable length to weight ratio, the rod being fastened throughout the entire length thereof to the inside of the tube;

(II) a shaft, the shaft being attached to the clubhead and having an alignment center axis for aligning the shaft with the center of the clubhead, such that the alignment center axis of the shaft intersects with the center of the clubhead and forms a lie angle of 65° to 76° with the horizontal center axis of the clubhead; and (III) wherein the shaft is bent so that it enters the clubhead in such a manner as to be attached to the clubhead directly behind the center of the clubhead yet the alignment center axis of the shaft intersects with the center of the clubhead.

5. The instrument set forth in claim 4 wherein the material of the rod comprises a plumbing water pipe.

6. The instrument set forth in claim 4 wherein the material of the tube is selected from the group consisting of copper, silver, gold, and combinations thereof.

* * * * *